United States Patent [19]

Watson

[11] Patent Number: 4,897,062

[45] Date of Patent: Jan. 30, 1990

[54] WATER WALKER'S PROPULSION POLE

[76] Inventor: Benjamin H. Watson, 2601 NE. 4th St., Renton, Wash. 98056

[21] Appl. No.: 261,698

[22] Filed: Oct. 24, 1988

[51] Int. Cl.[4] ..... B63H 16/04

[52] U.S. Cl. ..... 440/101; 416/86

[58] Field of Search ..... 440/101, 13, 17, 18; 441/76, 77; 416/70 R, 84, 85, 86

[56] References Cited

U.S. PATENT DOCUMENTS

| | | | |
|---|---|---|---|
| 2,589,698 | 3/1952 | Jackson | 416/86 |
| 4,527,984 | 7/1985 | Gilbert | 441/76 |
| 4,578,038 | 3/1986 | Lenten | 440/101 |
| 4,804,345 | 2/1989 | Lee | 440/101 |

FOREIGN PATENT DOCUMENTS

| | | | |
|---|---|---|---|
| 718523 | 1/1932 | France | 440/101 |

*Primary Examiner*—Sherman D. Basinger
*Assistant Examiner*—Thomas J. Brahan
*Attorney, Agent, or Firm*—Robert W. Jenny

[57] ABSTRACT

The subject pole is used to help propel a person on ski floats or water walkers. Each pole comprises a shaft with a hand grip at the top end and, in order from the bottom end: a small float, a propulsion apparatus and a larger float. The floats are bodies of revolution. The propulsion apparatus is a shell of revolution with a semi-elliptical shape and the long axis of the ellipse coincident with the longitudinal axis of the shaft and the open face of the shell facing the bottom end of the pole. The shell is slotted in four places to form four petals. The ends of the petals are interconnected by a garter spring. Also each petal is connected by two ties to a flange on the small float. In use the pole is moved fore and aft in alternate thrust and return strokes. It is at an angle to the water surface with the grip end higher and planes on the water surface in the return strokes and submerges to a depth limited by the buoyancy of the larger float on the thrust strokes.

6 Claims, 2 Drawing Sheets

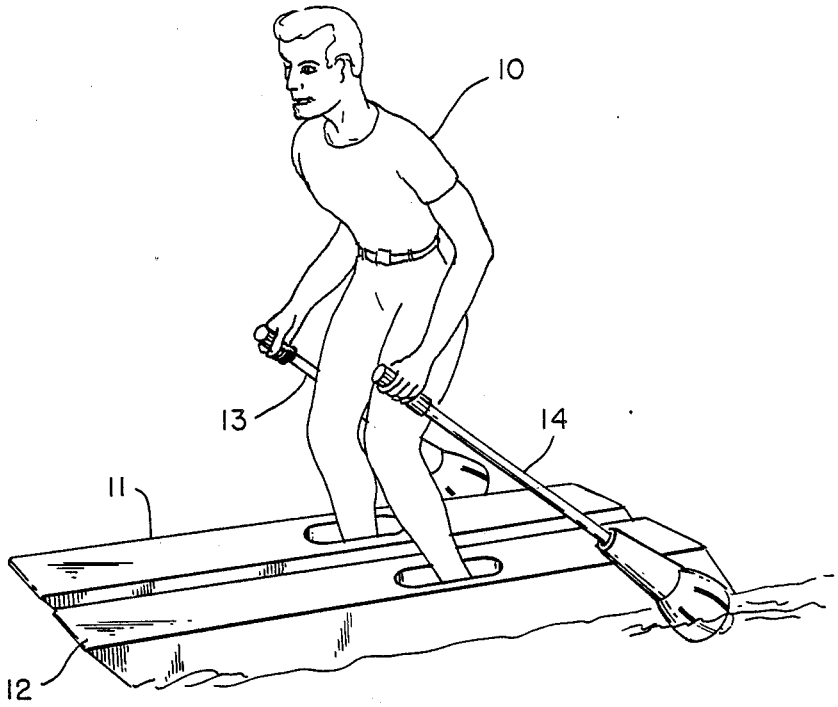
FIG. 1
FIG. 2
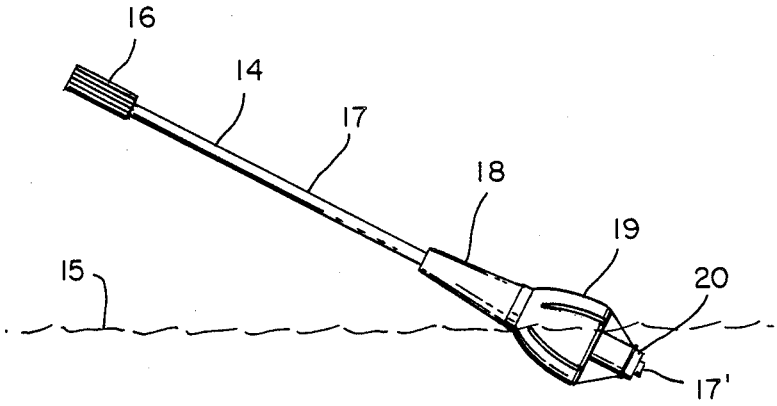

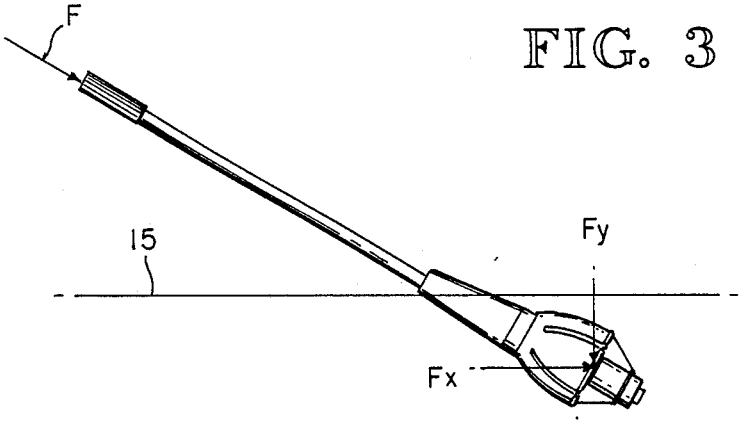
FIG. 3
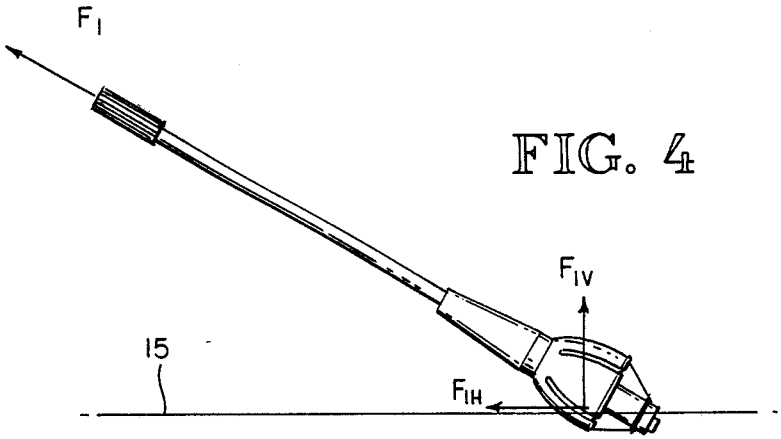
FIG. 4
FIG. 5
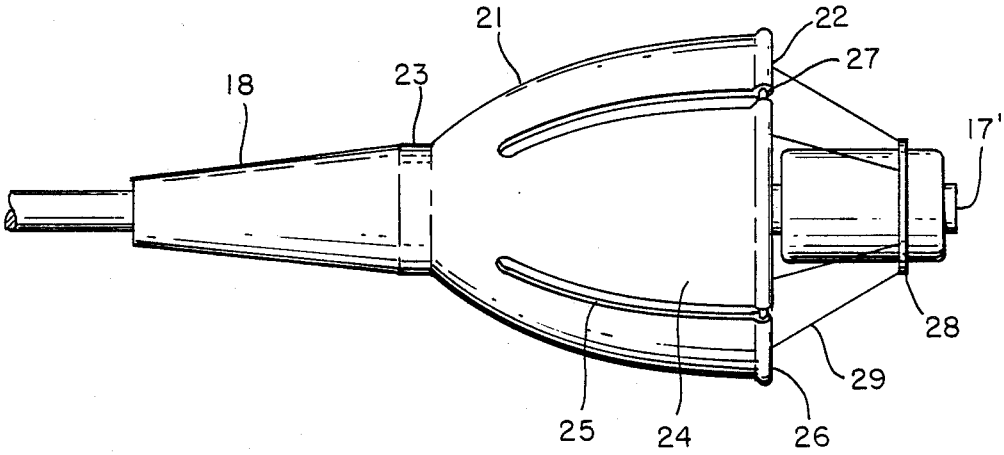

WATER WALKER'S PROPULSION POLE

BACKGROUND OF THE INVENTION

1. Field

The subject device is in the field of apparatus for propelling vessels, particularly hand operated apparatus such as oars, hand driven paddles, paddle wheels, propellers and the like. More specifically it is in the field of apparatus for assisting in the propulsion of apparatus known as water walkers, water walkers comprising flotation apparatus on which the user stands to be supported on the surface of a body of water and to be propelled across the surface by a walking motion.

2. Prior Art

Prior art apparatus useful in assisting in the propulsion of water walkers and the person(s) using them are shown in the following U.S. Pat. Nos. 3,027,576, 3,800,734, 4,527,984, 4,587,038, 4,650,433.

As indicated by the disclosures made in these patents the propulsion assistance apparatus is hand held and operated, comprising a shaft or the like having a handle at one end and a propulsion device at the other. The propulsion devices are intended to engage the water when forced aft by the user to provide a forward thrust to propel the user and to have minimal resistance to the water when moved forward by the user in preparation for making another propulsion thrust in the aft direction. A classic example of this type of apparatus found in nature is the feet of aquatic birds which fold closed on forward motion and open broadly for the thrust stroke.

Some of the prior art devices of the subject type are designed to have the water engagement apparatus always in the water during use with the apparatus changing configuration to provide maximum resistance to motion in the water during the thrust stroke and minimum resistance during the return stroke. Other prior art devices are designed to be in the water during the thrust stroke and out of it during the return stroke. In others the propulsion apparatus is only partly removed from the water during the return stroke and the subject apparatus is of this type since development work indicates that, with certain conditions met, this type is the most effective of the three in terms of propulsion achieved relative to skill and effort required. The conditions include automatic operation at desired immersion levels during thrust and return strokes, rapid expulsion of air from the propulsion apparatus at the beginning of the thrust stroke and no manual adjustments required for operation.

Accordingly, the objectives of the subject invention are to provide water walker's propulsion poles that meet the three cited conditions and are durable, lightweight and easily manufactured.

SUMMARY OF THE INVENTION

The subject pole comprises a shaft of the appropriate length with a hand grip at one end and, at the other, a first float at the tip of the pole, a propulsion apparatus and a second float just above the propulsion apparatus. The propulsion apparatus is an elastomeric elliptical shell of revolution with its open face directed toward the first float and its axis of revolution coincident with the axis of the shaft. The length of the shaft is such that when the handle end is in the range of shaft is such that when the handle end is in the range of heights of user's hands from the water surface and the propulsion apparatus is buoyed up by the first float the pole lies at an angle to the water in the range of 20° to 45°. The shell is slotted in four places to divide it into four equal sized petals. The slots extend from the open face in the range of 50 to 80 percent of the distance from the rim of the shell to its end. The edges of the petals coincident with the aft face of the shell are tubular and are interconnected by a garter spring threaded through the tubes. Each petal is connected by two lines, called ties, between the tubular edges and a flange on the first float. The garter spring and the ties help the slotted shell maintain its shape and prevent it from turning inside out under the action forces of the water.

In operation, with the pole at rest at an angle in the range of 20° to 45° to the water surface, the flotation provided by the first float is such that the shell is in the range of $\frac{1}{3}$ to $\frac{2}{3}$ submerged and the second float is essentially clear of the water. When the user applies force to the shaft, in the direction of its longitudinal axis, the downward component of the force and water action on the shell tend to submerge the shell; however, this is controlled by the flotation provided by the second float which arrests submersion when the shell is fully submerged and in full engagement with the water. Any air that might be trapped in the shell escapes through the slots which are wide enough to allow the air to escape rapidly but not so wide that working area of the shell is significantly decreased. Also, when the pole is moved through a return stroke, the slots allow air to enter the shell so that no significant mass of water is "sucked" forward by the shell.

The invention is described in more detail below with reference to the attached drawings.

BRIEF DESCRIPTION OF THE DRAWINGS

FIG. 1 is a view of two of the subject poles in use.

FIG. 2 is a side view of a pole at rest in the hand of a user.

FIG. 3 is a side view of a pole during a thrust stroke.

FIG. 4 is a side view of a pole during a return stroke.

FIG. 5 illustrates the shell (propulsion apparatus) of the pole in more detail.

DETAILED DESCRIPTION OF THE INVENTION

The subject pole is intended for use in pairs by persons on ski floats, or water walkers, water walkers being ski floats equipped with apparatus such that the user's walking motions propel the user over the surface of the water. This propulsion can be enhanced by the subject poles moved alternately through thrust and return strokes by swinging of the user's arms.

In FIG. 1 user 10 is standing at rest in floats 11 and 12 and holding poles 13 and 14. FIG. 2 is a side view of FIG. 1 and illustrates pole 14 in more detail and its position relative to water surface 15 in the at rest situation. The pole comprises handle 16, shaft 17, upper float 18, propulsion apparatus 19 and lower float 20. The buoyancy of float 20 produces a buoyant force such that in the at rest condition the upper float is out of the water and the propulsion apparatus is partially submerged.

FIG. 3 illustrates the thrust stroke situation in which the user is exerting a thrust on the pole, thrusting it rearward to generate force in the forward direction. The thrust line is coincident with the longitudinal axis of the shaft. At the propulsion apparatus the thrust force F comprises two component forces $F_y$ and $F_x$ vertical and horizontal respectively. The horizontal component serves to propel the user, floats, etc. The vertical force component tends to submerge the propulsion apparatus and the upper float. The buoyancy of the upper float increases as more of it is submerged until the buoyancy force balances the vertical force component and the situation stabilizes with the propulsion apparatus essentially fully submerged and offering its optimum resistance to rearward movement in the water; i.e. optimum propulsive force.

FIG. 4 illustrates the return stroke situation with the user moving the pole forward in preparation for another thrust stroke. In this situation force $F_1$ is acting along the longitudinal axis of the shaft and, at the propulsion apparatus, comprises vertical and horizontal components, $F_{1V}$ and $F_{1H}$. $F_{1H}$ is felt as drag on the pole and $F_{1V}$ is tending to lift it out of the water. This lift is abetted by the planing action of the apparatus on the water and the apparatus skims the surface, offering little resistance to the forward motion.

FIG. 5 illustrates the propulsion apparatus in detail. It comprises shell 21 which is a body of revolution semi-elliptical in shape with maximum diameter at the open end 22 which faces end 17' of the shaft and with its axis of revolution coincident with the longitudinal axis of the shaft. The shell has a hub 23 at its apex and is fastened to the shaft by a fastener, not visible, through the hub and shaft. The shell is divided into four petals, petal 24 being typical by 4 slots, slot 25 being typical. The slots are parallel to the axis of revolution of the shell and extend from open end 22 almost to the hub. Rim 26 of end 22 is tubular and garter spring 27 is installed in the tube segments in the petals. Each petal is connected to flange 28 on float 20 by two lines called ties, tie 29 being typical. The ties are attached by tying, adhesives or mechanical means at the designer's choice. The ties and spring serve to stabilize and position end 22 and prevent the shell from turning inside out. The slots eliminate entrapment of air in the shell when it submerges during the beginning of a thrust stroke and allow rapid escape of water at the beginning of each return stroke to avoid the drag that would be caused by water trapped by suction in the shell.

It is considered that it is understandable from this description that the invention meets its objectives. The propulsion apparatus automatically seeks immersion levels optimum for both thrust and return strokes, the smaller float helping during the return stroke and the larger float being effective during the thrust stroke. The slots avoid deleterious entrapment of air and water and no manual manipulations are required for operation of the poles. Also, the apparatus can be seen to be durable, lightweight and easily manufactured.

It is also considered understandable that while one embodiment of the invention is described herein, other embodiments of the invention and modifications of the one described are possible within the scope of the invention which is limited only by the attached claims.

What is claimed is:

1. A water walker's propulsion pole for use over a body of water, said use comprising an at rest situation, a thrust stroke situation and a return stroke situation, said pole comprising:

a shaft having a first end and a second end and a longitudinal axis, a hand grip, a first float having a first buoyant force, a second float having a second buoyant force and a propulsion apparatus having a maximum diameter, said hand grip being installed on said first end, said first float being installed on said second end, said propulsion apparatus being installed on said shaft adjacent to said first float, said second float being installed on said shaft adjacent to said propulsion apparatus, whereby with said propulsion apparatus installed between said first and second floats, said floats function to maintain said propulsion apparatus at desired distances of immersion in said body of water during use of said pole.

2. The pole of claim 1 in which said first buoyant force is such that with said pole supported over a body of water by said hand grip and said first buoyant force and in said at rest situation said propulsion apparatus is partially immersed in said water, and such that in said thrust stroke situation said propulsion apparatus is fully immersed in said water and such that during said return stroke situation said propulsion apparatus skims said water.

3. The pole of claim 2 in which said propulsion apparatus comprises a shell of revolution having an open end, an apex, a hub at said apex and an axis of revolution, said shell being installed on said shaft with said axis of revolution coincident with said longitudinal axis and said open end facing said second end.

4. The pole of claim 1 in which said propulsion apparatus comprises a shell of revolution having an open end, an apex, a hub at said apex and an axis of revolution, said shell being installed on said shaft with said axis of revolution coincident with said longitudinal axis and said open end facing said second end.

5. The pole of claim 4 in which said shell has a tubular rim at its open face and a plurality of slots parallel to said longitudinal axis dividing said shell into a plurality of petals and said propulsion apparatus further comprises:

a garter spring, a plurality of ties and a flange around said first float, said garter spring being inserted in said tubular rim to interconnect said petals, said petals being connected to said flange by said ties connected between said tubular rim and said flange.

6. The pole of claim 4 in which said propulsion apparatus comprises a shell of revolution having an open end, an apex, a hub at said apex and an axis of revolution, said shell being installed on said shaft with said axis of revolution coincident with said longitudinal axis and said open end facing said second end.

* * * * *